United States Patent [19]

Elves et al.

[11] Patent Number: 4,551,377

[45] Date of Patent: Nov. 5, 1985

[54] ABSORBENT PADS

[75] Inventors: John Elves, Magor, Wales; Stephen J. Ley, Nr. Lydney, England

[73] Assignee: Chicopee, New Brunswick, N.J.

[21] Appl. No.: 492,917

[22] Filed: May 9, 1983

[30] Foreign Application Priority Data

Jun. 10, 1982 [GB] United Kingdom ..... 8216937

[51] Int. Cl.[4] ..... B32B 5/28; B65D 81/26; D04H 1/48; D04H 1/66

[52] U.S. Cl. ..... 428/137; 426/106; 426/129; 426/132; 427/288; 427/294; 427/428; 428/195; 428/198; 428/207; 428/215; 428/219; 428/220; 428/290; 428/306.6; 428/317.3; 428/317.7; 428/319.7

[58] Field of Search ..... 426/129, 132, 106; 604/381; 428/198, 195, 137, 207, 215, 219, 220, 290, 306.6, 317.3, 317.7, 319.7; 427/288, 394, 428

[56] References Cited

U.S. PATENT DOCUMENTS

| | | | |
|---|---|---|---|
| 3,616,146 | 10/1971 | Gabet | 428/286 |
| 3,763,502 | 10/1973 | Lauman | 604/381 |
| 3,916,447 | 11/1975 | Thompson | 428/286 |
| 3,936,555 | 2/1976 | Smith | 428/286 |
| 4,107,426 | 8/1978 | Gordon | 604/381 |
| 4,132,821 | 1/1979 | Hiers et al. | 428/286 |
| 4,161,422 | 7/1979 | Lawson et al. | 428/198 |
| 4,207,367 | 6/1980 | Baker | 428/198 |
| 4,239,792 | 12/1980 | Ludwa | 428/198 |
| 4,276,345 | 6/1981 | Maranghi | 428/287 |
| 4,321,997 | 3/1982 | Miller | 426/129 |
| 4,326,000 | 4/1982 | Roberts | 428/195 |
| 4,338,371 | 7/1982 | Dawn et al. | 428/286 |
| 4,379,192 | 4/1983 | Wahlquist | 428/284 |
| 4,381,616 | 5/1983 | Wishmon | 428/284 |
| 4,410,578 | 10/1983 | Miller | 426/129 |
| 4,415,617 | 11/1983 | D'Elia | 428/97 |

FOREIGN PATENT DOCUMENTS 1494525 12/1977 United Kingdom .

*Primary Examiner*—James C. Cannon

[57] ABSTRACT

An absorbent pad of non-woven fabric having high absorbency and integrity has on one side a layer of binder material for providing a surface having an absorbency reduced with respect to the remainder of the pad, the remainder of the pad being free of binder.

22 Claims, No Drawings

ABSORBENT PADS

BACKGROUND OF THE INVENTION

The invention relates to absorbent pads, and more particularly but not exclusively to pads for use in absorbing exudates from meat, particularly where meat is packaged for retail sale in places such as supermarkets. Such pads for absorbing exudates from meat are known as "meat pads".

Meat packaging for retail sale commonly takes two forms:

(i) The use of an expanded polystyrene tray in which the meat is placed, and the package is then wrapped in a film of clear plastics material.

(ii) Where packaging is carried out at a site remote from a retail sale, the meat is commonly packed in a clear polystyrene tray with a heat sealed, clear lid of plastics material.

A problem associated with pre-packaging meat in ways such as those described above is that exudates from the meat build up in the bottom of the tray. Although the presence of exudate does not detract from the quality of the meat, the appearance of the pack is adversely affected, and in some instances fluid can penetrate film wrapped packs.

To absorb excess fluid, a meat pad is placed beneath the meat. However, the pad should not present a highly absorbent surface to the meat which would draw fluid from the meat, causing it to dry out.

Various attempts have been made to produce an absorbent pad suitable for use as a meat pad; for example a laminate of a highly absorbent multi-ply tissue and polyethylene, the polyethylene layer uppermost, or pads of wet strength crepe paper and non-woven fabric. The tissue/polyethylene pads have a problem that when the pads are saturated they have low abrasion resistance and tend to break up. The wet strength crepe paper and non-woven fabric pads tend to lack absorbency and often do not fully overcome the problem of excess fluid.

According to the invention, there is provided on absorbent pad of non-woven fabric having high absorbency and integrity, the pad having on one side a layer of binder material for providing a surface having an absorbency reduced with respect to the remainder of the pad, the remainder of the pad being free of binder.

Suitable fibers for the non-woven fabric material are viscose rayon and especially super absorbent viscose rayons, and polyvinyl alcohol.

Suitable binder materials are acrylic or polyvinyl acetate, or copolymers comprising these materials. The binder may contain a pigment.

The pad may have apertures formed therein to allow fluid to pass through the binder layer.

The pad may be approximately 1 mm thick, and the thickness of the binder layer may be approximately 0.2 mm.

The fabric may weigh between 50 and 200 $gm^{-2}$, and preferably between 100 and 150 $gm^{-2}$. The binder preferably comprises between 2% and 20%, preferably between 5% and 10% of the total pad weight.

The materials used are safe for their intended purpose.

SUMMARY OF THE INVENTION

According to the invention there is further provided a method of manufacturing an absorbent pad according to the invention comprising the steps of entangling a web of absorbent textile fibres, and applying a layer of binder material to the web.

The fibres may be entangled by needle punching or preferably by the action of high pressure jets of a fluid such as water while the web is supported on a woven belt. The web is preferably dried after the binder is applied.

The binder may be applied by a roller, for example a gravure print roller, but other methods, for example knife or calender coating could be used.

The belt is preferably sufficiently coarse to form apertures in the web.

The invention further provides an absorbent pad made by a method according to the invention.

DETAILED DESCRIPTION OF THE PREFERRED EMBODIMENT

By way of example, one embodiment of an absorbent pad and a method of manufacture thereof will now be described with reference to the following example.

A web of textile fibres was entangled by the action of high pressure water jets, while supported on a woven belt. The belt was sufficiently coarse to form apertures in the web.

The web in the preferred example has a weight of 105 $gm^{-2}$ and comprises 50% viscose and 50% Courtaulds Super Inflated Viscose, and was entangled using water jets at a pressure of 500 p.s.i. A greater proportion of super inflated fibre could be used, depending on cost and performance requirements. During entangling, the web was supported on a coarse woven belt to give the entangled web a perforated effect. After entangling, the web was coated on one side with 5 $gm^{-2}$ of a binder based on a self crosslinking ethyl acrylate copolymer pigmented by the addition of a pink "food wrapper" grade pigment. Other colours could be used.

The fabric was dried over steam heated drying cylinders and the final thickness of the fabric was approximately 1 mm.

All the constituents of the fabric had been previously tested and found to be suitable for use in contact with food, including meat.

The binder was applied using a gravure print roller. The roller had a pattern of 9 lines per cm extending spirally, the engraving size being about 0.46 mm across and about 0.09 mm deep. The binder material is of high viscosity to prevent penetration of the web, a typical viscosity range being 5 and 10 poise. Other methods of binder application could be used.

Testing of fabric made in accordance with the preferred example showed a total absorbency 60–100% better then crepe paper or conventional non-woven fabric. On the unbonded side, the material had good abrasion resistance. The bonded side of the material, while being pervious to fluids by virtue of the perforations, had restricted absorbency itself, as capillaries are blocked by binder material.

In use, with the bonded side in contact with the meat the pad has sufficient absorbency to absorb exudates from the meat, while the restricted absorbency bonded side prevents fluids being drawn from the meat.

We claim:

1. An absorbent pad of non-woven fabric comprising absorbent textile fibers, said fabric having high absorbency and integrity, the pad having on one side a layer of binder material for providing a surface having an absorbency reduced with respect to the remainder of the pad, the remainder of the pad being free of binder, said fabric having apertures formed therein for allowing fluid to pass through the binder layer.

2. An absorbent pad as claimed in claim 1 wherein the binder comprises between 2% and 20% of the total pad weight.

3. An absorbent pad as claimed in claim 2 wherein the binder comprises between 5% and 10% of the total pad weight.

4. An absorbent pad as claimed in claim 1 having a thickness of approximately 1 mm.

5. An absorbent pad as claimed in claim 4 wherein the binder layer is approximately 0.2 mm thick.

6. An absorbent pad as claimed in claim 1 wherein the fabric weighs between 50 and 200 $gm^{-2}$.

7. An absorbent pad as claimed in claim 6 wherein the fabric weighs between 100 and 150 $gm^{-2}$.

8. An absorbent pad as claimed in claim 1 wherein the non-woven fabric material is viscose rayon.

9. An absorbent pad as claimed in claim 8 wherein the material is super absorbent viscose rayon.

10. An absorbent pad as claimed in claim 1 wherein the non-woven fabric material is polyvinyl alcohol.

11. An absorbent pad as claimed in claim 1 wherein the binder includes a pigment.

12. An absorbent pad as claimed in claim 1 wherein the binder is acrylic.

13. An absorbent pad as claimed in claim 1 wherein the binder is polyvinyl acetate.

14. An absorbent pad as claimed in claim 12 wherein the binder is a copolymer.

15. An absorbent pad as claimed in claim 13 wherein the binder is a copolymer.

16. An absorbent pad of non-woven fabric having high absorbency and integrity, the pad having on one side a layer of binder material for providing a surface having an absorbency reduced with respect to the remainder of the pad, the remainder of the pad being free of binder, the binder comprising between 2% and 20% of the total pad weight, the pad being approximately 1 mm thick and the pad having apertures for allowing fluid to pass through the binder layer.

17. A method of manufacturing an absorbent pad as claimed in claim 1 comprising the steps of entangling a web of absorbent textile fibres, forming apertures therein, and applying a layer of binder material to the web.

18. A method as claimed in claim 17 wherein the fibres are supported on a woven belt and high pressure jets of fluid are used to entangle the fibres.

19. A method as claimed in claim 18 comprising the step of drying the web after the binder is applied.

20. A method as claimed in claim 18 wherin the belt is sufficiently coarse to form apertures in the web.

21. A method as claimed in claim 17 wherein the fibres are entangled by needle punching.

22. A method as claimed in claim 17 wherein the binder is applied by a roller.

* * * * *